US010707045B2

(12) United States Patent
Castner

(10) Patent No.: US 10,707,045 B2
(45) Date of Patent: Jul. 7, 2020

(54) ELASTOMERIC JOYSTICK ASSEMBLY

(71) Applicant: Peter Castner, Peabody, MA (US)

(72) Inventor: Peter Castner, Peabody, MA (US)

(73) Assignee: CSI Keyboards, Inc., Peabody, MA (US)

( * ) Notice: Subject to any disclaimer, the term of this patent is extended or adjusted under 35 U.S.C. 154(b) by 9 days.

(21) Appl. No.: 15/935,164

(22) Filed: Mar. 26, 2018

(65) Prior Publication Data

US 2019/0295800 A1 Sep. 26, 2019

(51) Int. Cl.

| | |
|---|---|
| ***H01H 23/06*** | (2006.01) |
| ***H01H 89/00*** | (2006.01) |
| ***H01H 25/04*** | (2006.01) |

(52) U.S. Cl.

CPC ..... *H01H 89/00* (2013.01); *H01H 23/06* (2013.01); *H01H 25/041* (2013.01); *H01H 2025/048* (2013.01); *H01H 2221/012* (2013.01); *H01H 2221/044* (2013.01); *H01H 2223/002* (2013.01); *H01H 2223/024* (2013.01)

(58) Field of Classification Search

CPC ..... H01H 13/14; H01H 3/125; H01H 13/705; H01H 2221/044; H01H 2215/004; H01H 2221/036; H01H 13/06; H01H 13/063; H01H 2009/048; H01H 2013/066; H01H 13/04; H01H 2221/012; H01H 2223/002; H01H 23/06; H01H 25/04; H01H 9/02; H01H 9/04

See application file for complete search history.

(56) References Cited

U.S. PATENT DOCUMENTS

| | | | | |
|---|---|---|---|---|
| 4,766,271 A * | 8/1988 | Mitsuhashi | H01H 13/702 | 200/5 A |
| 5,008,505 A * | 4/1991 | Takano | H01H 13/12 | 200/260 |
| 5,788,059 A * | 8/1998 | Jahangiri | H01H 21/08 | 200/302.3 |
| 6,474,833 B1 * | 11/2002 | Parsons | F21L 4/005 | 200/60 |
| 6,635,838 B1 * | 10/2003 | Kornelson | H01H 9/041 | 200/302.2 |
| 7,411,521 B2 * | 8/2008 | Lewis | G05G 9/047 | 200/6 A |
| 7,560,653 B1 * | 7/2009 | Sage | H01H 9/04 | 200/302.1 |
| 7,964,812 B1 * | 6/2011 | Schwinn | H01H 9/04 | 200/302.3 |
| 8,575,506 B2 * | 11/2013 | Kitahara | H01H 13/06 | 200/302.2 |

(Continued)

*Primary Examiner* — Ahmed M Saeed

(74) *Attorney, Agent, or Firm* — Law Offices of Daniel A. Tesler, LLC

(57) ABSTRACT

The present invention provides, in some aspects, a rugged and inexpensive joystick assembly comprising a core configured to manipulate a series of switches and located by an elastomeric overlay. The elastomeric overlay can include a tactile surface for a user, a water-resistant coating for a switch panel and a flex-wall disposed between the tactile surface and switch panel coating. The elastomeric overlay can be configured to positively locate the joystick core relative to the switch panel and provide a water-tight seal. The thickness, width and hardness of the flex-wall can be tuned to provide adequate locating strength and resistance to wear.

9 Claims, 7 Drawing Sheets

(56) References Cited

U.S. PATENT DOCUMENTS

| | | | | |
|---|---|---|---|---|
| 9,018,553 | B1 * | 4/2015 | Arnold | H01H 23/06 200/302.3 |
| 2008/0121506 | A1 * | 5/2008 | Lee | H01H 13/86 200/302.1 |
| 2013/0032457 | A1 * | 2/2013 | Quinn | H01H 13/32 200/341 |
| 2014/0083833 | A1 * | 3/2014 | Desplaines | G05G 9/047 200/6 A |

* cited by examiner

SECTION A-A

ELASTOMERIC JOYSTICK ASSEMBLY

FIELD OF THE INVENTION

The present invention relates to electric switches and, in particular, to an elastomeric joystick assembly.

BACKGROUND OF THE INVENTION

Electrical switches are used across many industries and types of devices as a means for inputting commands. One subset of electrical switches, capable of providing multiple inputs to a system, are joystick switches (hereinafter "joysticks"). A joystick is an input device that generally uses an elongate member that can be manipulated to generate one or more input signals for a device. Joysticks can be configured to control the motion of a device or apparatus, where a movement of the elongate member outputs a command to the device or apparatus to move in a certain direction.

BRIEF SUMMARY OF THE INVENTION

In some embodiments, the present invention provides a rugged and inexpensive joystick comprising a core configured to manipulate a series of contact switches and located by an elastomeric overlay. The elastomeric overlay can include a tactile surface for a user, a water-resistant coating for a switch panel and a flex-wall disposed between the tactile surface and switch panel coating. The elastomeric overlay can be configured to provide a water-resistant joint between the movable portion of the joystick and the stationary switch panel.

The elastomeric overlay can be configured to positively locate the joystick core relative to the switch panel. In some embodiments, the flex-wall is thinner than the elastomeric overlay over the joystick and the switch panel, extending laterally between the joystick and switch panel coatings without slack. When the flex-wall is configured to extend laterally without slack, the flex-wall is largely not under tension or compression when the joystick in its upright or neutral/equilibrium position. Once the joystick is manipulated in a direction of motion, the flex-wall opposite the direction of motion is pulled under tension, preventing the joystick from significant lateral motion relative to the switch panel and providing a righting force that brings it back to the upright or neutral/equilibrium position.

The use of a lateral flex-wall to locate the joystick relative to the switch panel greatly reduces the complexity of the joystick assembly because other locating links between the joystick core and the switch panel are not required. Since the elastomeric surface provides the locating function for the joystick, the switch panel does not require any additional reinforcement or support to provide a locating function.

In developing this elastomeric joystick, it was discovered that specific elastomeric overlay materials, hardness values, flex-wall thickness values and flex-wall lateral width values were particularly effective at providing peak performance and durability.

DETAILED DESCRIPTION OF THE INVENTION

Figure 1:
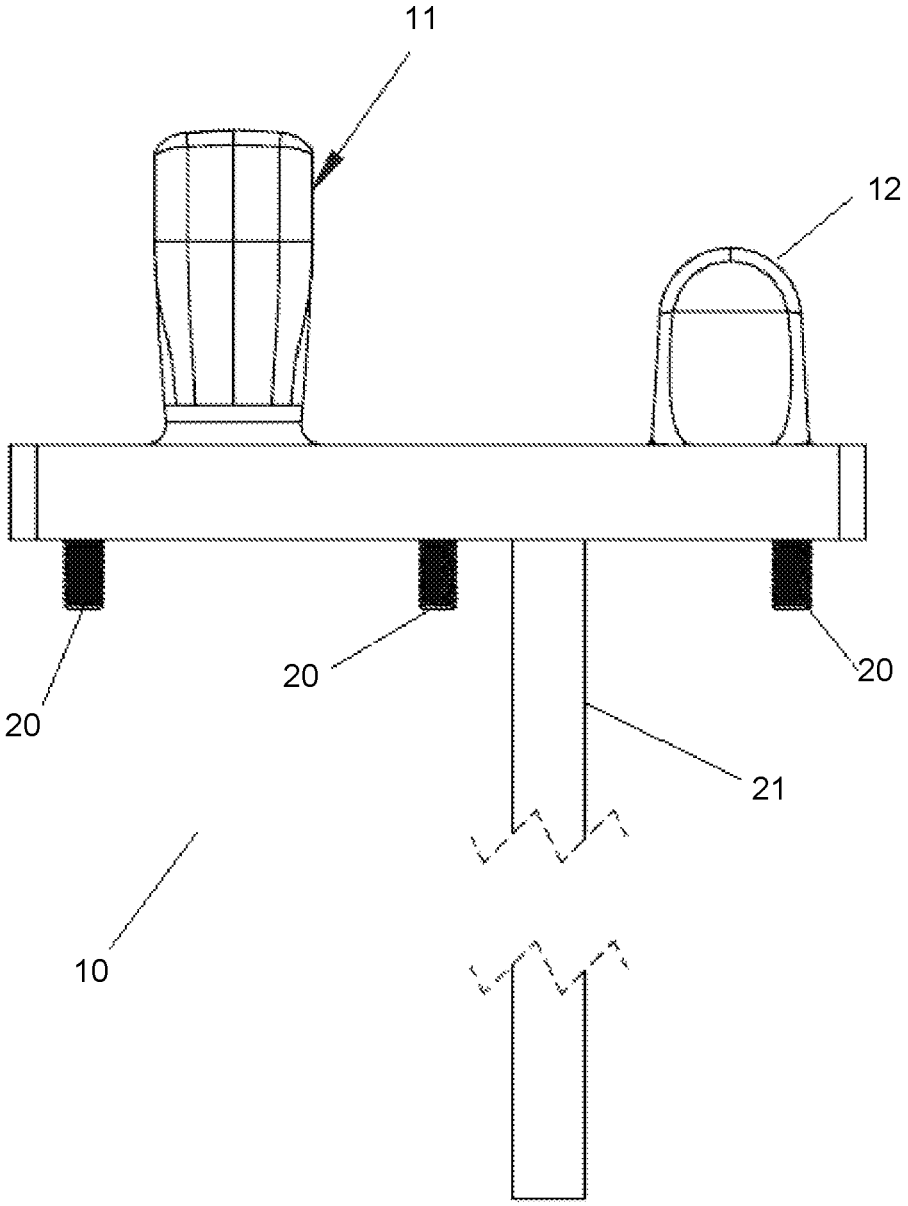
FIG. 1 is a front view of an exemplary embodiment of a switch panel with a joystick and a rocker switch.

In FIG. 1 is a front view of an exemplary embodiment of a switch panel 10 including a joystick assembly 11 disclosed herein. While one example of a joystick is fully disclosed, it is appreciated that a person skilled in the art could modify the joystick, within the scope of the inventive concept expressed herein, to suit a particular application.

The exemplary embodiment of a switch panel 10 includes a joystick 11 and a rocker switch 12, mounted and extending upward from the switch panel surface. The use of directions, such as upward and downward, are exemplary in nature and are used merely identify features for clarity. The switch panel 10, joystick 11 and rocker switch 12 could be mounted in any position, making the exemplary directions disclosed herein only relevant to the orientation of the figures presented.

The present disclosure is directed towards the joystick assembly 11 located on the switch panel 10. The inclusion of a rocker switch 12 on the switch panel 10 is optional. In some embodiments, multiple joysticks 11 can be included on the switch panel 10. In some embodiments, multiple rocker switches 12 can be included on the switch panel 10. In some embodiments, multiple rocker switches 12 and multiple rocker switches can be included on the switch panel 10. In some embodiments, only a single joystick 11 can be included on the switch panel 10. In some embodiments, one or more joysticks 11 can be mounted on an assembly other than a switch panel 10.

The switch panel 10 can include a means for securing it to a surface. In the exemplary embodiment, a plurality of threaded rods 20 extend downward through the bottom of the switch panel 10 to provide points of attachment to a surface. The threaded rods 20 can pass through a mounting surface at their proximate end relative to the switch panel 10 and a fastener can be attached to their distal ends, sandwiching the mounting surface between the bottom of the switch panel and the fastener. While threaded rods 20 are used as a fastening means on the switch panel 10, it is appreciated that there are other fastening means known in the art that are also suitable for securing the switch panel 10 to a surface. Other appropriate fastening means include, but are not limited to, adhesives, hook and loop fasteners, and threaded opening configured to accept screws.

Extending downward from the switch panel 10 is a communication wire 21 to electrically connect the switch panel 10 to a system. In some embodiments, the communication wire 21 can be substituted with a wireless communication system. The communication wire 21 can perform the function of transmitting inputs entered into the switch panel 10 to a system. In some embodiments, the communication wire can transmit signals back to the switch panel 10 for purposes, including but not limited to, illuminating lights, providing feedback through the joystick assembly 11, energizing speakers, etc. The switch panel 10 can be used to input commands to a variety of systems, including but not limited to, snow blowers, wheel chairs and metal detectors. The joystick assembly 11 of the switch panel 10 is particularly useful for use in harsh environments that require waterproof or water-resistant switches. The joystick assembly 11 is also particularly useful for use in locations where it would be impractical to package a joystick array.

Figure 2:
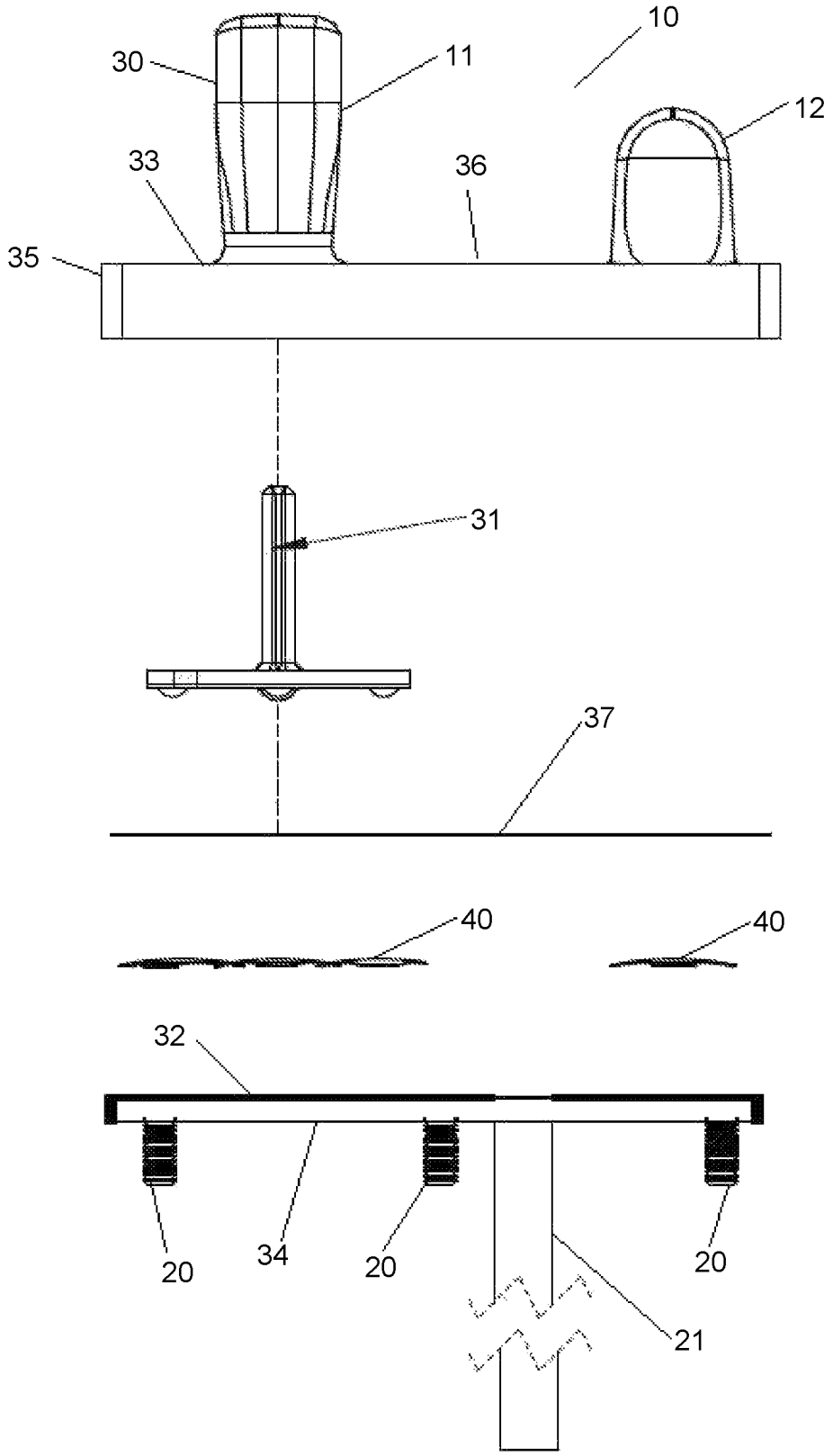
FIG. 2 is an exploded front view of the exemplary embodiment of a switch panel with a joystick and a rocker switch.
Figure 3:
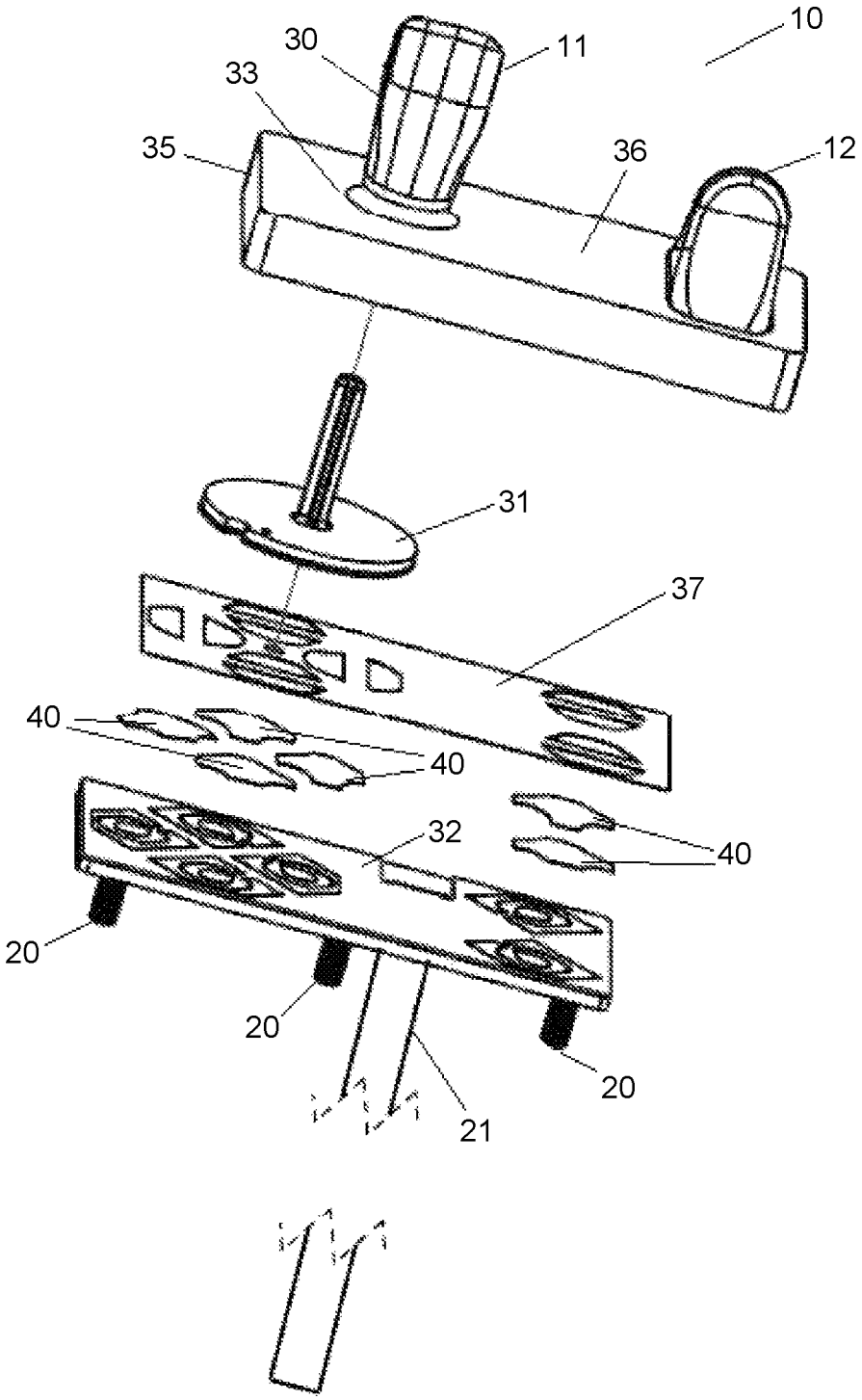
FIG. 3 is an exploded perspective view of the exemplary embodiment of a switch panel with a joystick and rocker switch.

IN FIG. 2 is a front exploded view of a switch panel 10, showing internal components. The joystick 11 mounted on the switch panel 10 comprises an internal actuator arm 31, a base 32, switches 40, an optional dome retainer layer 37 and a switch panel overlay material 35. The switch panel overlay material 35 preferably locates the internal actuator arm 31 relative to the base 32 and the switches 40. The switch panel overlay material 35 comprises a joystick overlay 30, a flex-wall 33 and a base connection area 36.

In some embodiments, the internal actuator arm 31 is configured as a rigid or semi-rigid component to provide structure to the joystick assembly. In some embodiments, the internal actuator arm 31 can have a higher stiffness than the joystick overlay 30. When the internal actuator arm 31 is configured to provide structure to the joystick assembly, the joystick overlay 30 can be substantially unstressed during use and optimized for tactile properties.

In some embodiments, the internal actuator arm 31 can be constructed from acrylonitrile butadiene styrene (hereinafter "ABS") thermoplastic polymer. In other embodiments, the internal actuator arm 31 can be constructed out of a metallic material, other polymers, a molded plastic, a natural rubber, a synthetic rubber or a material comprised in part of the aforementioned materials. In embodiments where the internal actuator arm 31 is comprised of a natural rubber or a synthetic rubber mixture, the internal actuator arm 31 can have a higher hardness on the Shore A Hardness Scale (hereinafter "hardness") than the overlay material 30 and the flex-wall 33 to provide structure to the joystick assembly 11.

The base 32 can be any structure configured to provide a surface for the internal actuator arm to pivot and to support one or more momentary switches. In some embodiments, the base 32 is a printed circuit board. In some embodiments, the base 32 is a flex circuit, meaning a circuit mounted on a flexible substrate, such as plastic, polymide, polyether ether ketone (PEEK) or a conductive polyester. Fixed to the upper surface of the base 32 are one or more switches 40 configured to be actuated by the internal actuator arm 31. The internal actuator arm 31 is substantially located by the switch panel overlay material 35, but the base 32 can provide a lower pivot point for the internal actuator arm 31 to provide a consistent joystick deflection angle required for switch actuation. The joystick deflection angle required for switch actuation is generally the angle the joystick must be moved from an upright or equilibrium position to actuate a switch.

The switches 40 can be mounted directly to the base 32 via multiple methods known in the art. In some applications, an optional dome retainer layer 37 can be added on top of the switches 40 to provide a more robust switch panel 10. The dome retainer layer 37 can be a continuous sheet of material or a sheet of material with openings corresponding to the size of the switches 40. In some embodiments, the dome retainer layer 37 is a sheet of polyester that is between and including 0.003 inches to 0.005 inches thick. In some embodiments, the dome retainer layer 37 secures the switches 40 from up and down or lateral movement relative to the base 32.

In some embodiments, the switches 40 are momentary switches configured to be actuated by the internal actuator arm 31. In some embodiments, there are four momentary switches 40 equally spaced about the axial center of the internal actuator arm's disk-shaped base. A joystick assembly 11 with four momentary switches 40 can be useful for directional control over a system or piece of equipment. Some embodiments can have fewer than four momentary switches 40 and some embodiments can have more than four momentary switches. Various types of momentary switches 40 can be appropriate for this application, including but not limited to, micro-switches and dome switches. While momentary switches 40 are disclosed herein, it is appreciated that various types of switch configurations could be appropriate in some applications. Appropriate switch configurations could include a switch in a normally open configuration, a switch in a normally closed configuration or a switch in an actuate (such as push) on, actuate off configuration.

In some embodiments, the switches 40 are configured to provide an amount of electrical power correlated to the amount of pressure exerted on the switches 40. The switches 40 can comprise potentiometers actuated by a mechanical force or pressure. In some embodiments, the switches comprise a pressure sensitive conductive rubber material configured to adjust circuit resistance in response to a mechanical force or pressure. Switches 40 configured as potentiometers are useful in applications where it is desirable to control electrical power to a system with more precision than a simple on or off circuit.

In some embodiments, the joystick 11 further comprises a rotary switch. A rotary switch can be incorporated in the internal actuator arm 31, allowing the vertical elongate member 52 to rotate relative to the disk 51. A rotary switch could also be incorporated below the base 32 so that the entire joystick assembly 11 could rotate relative to a rotary switch mechanism.

Figure 4:
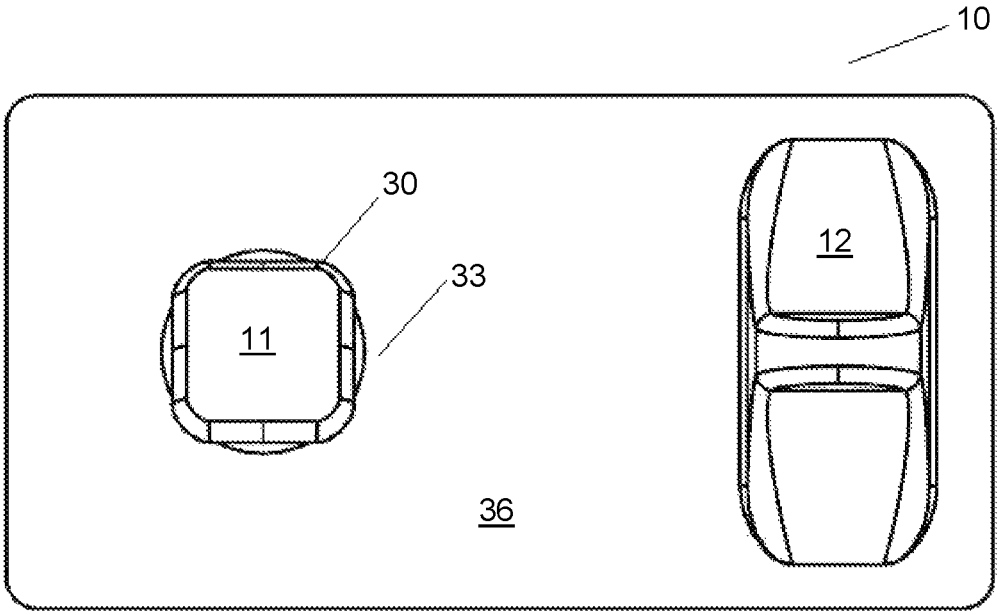
FIG. 4 is a top view of the exemplary embodiment of a switch panel with a joystick and a rocker switch.
Figure 5:
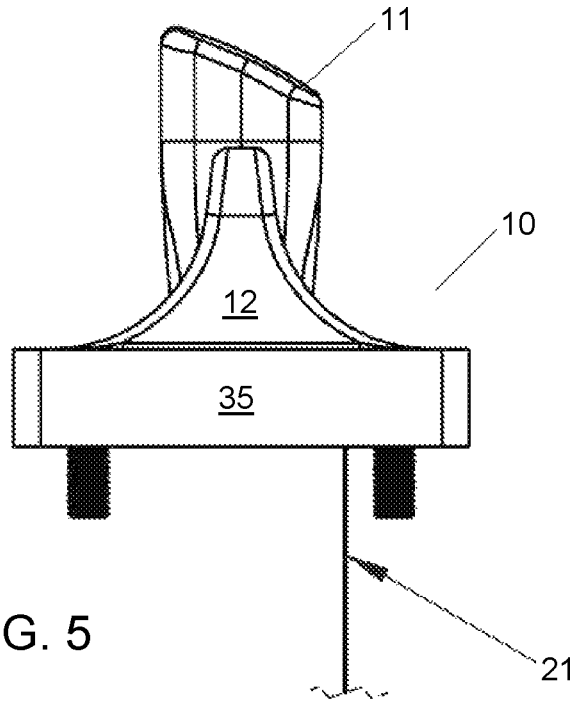
FIG. 5 is a side view of the exemplary embodiment of a switch panel with a joystick and a rocker switch.

In FIG. 4 is a top view of the switch panel 10 showing an exemplary lateral spacing between a joystick 11 and a rocker switch 12. In FIG. 5 is a side view of the switch panel 10 showing the side profile of the joystick 11 and rocker switch 12. In the exemplary embodiment, the joystick 11 has a cylindrical shape with squared off edges and an angled top. The squared off edges of the joystick 11 can correspond to the directions of the momentary switches 40 from the internal actuator arm 31 to assist the user in identifying the location of the momentary switches 40. The angled top can also be used to assist the user in identifying the orientation of the momentary switches 40. For example, the exemplary embodiment has an angled top sloping downward to the rear of the switch panel 10. A user would be able to quickly identify the orientation of the switch panel by the raised edge towards the front of the switch panel and the lower edge towards the rear.

Figure 6:
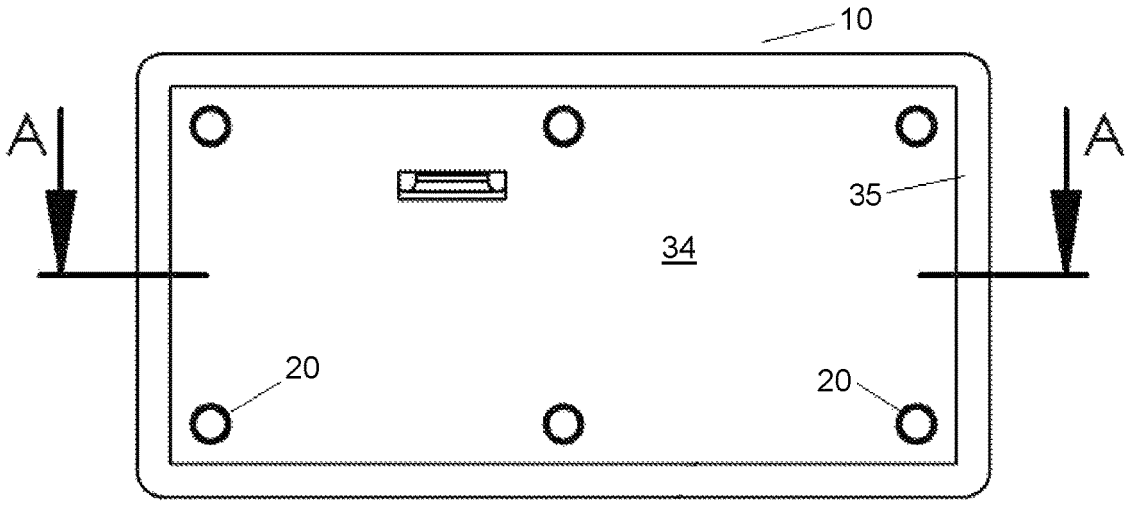
FIG. 6 is a bottom view of the exemplary embodiment of a switch panel, also showing the location of section A-A in FIG. 7.
Figure 7:
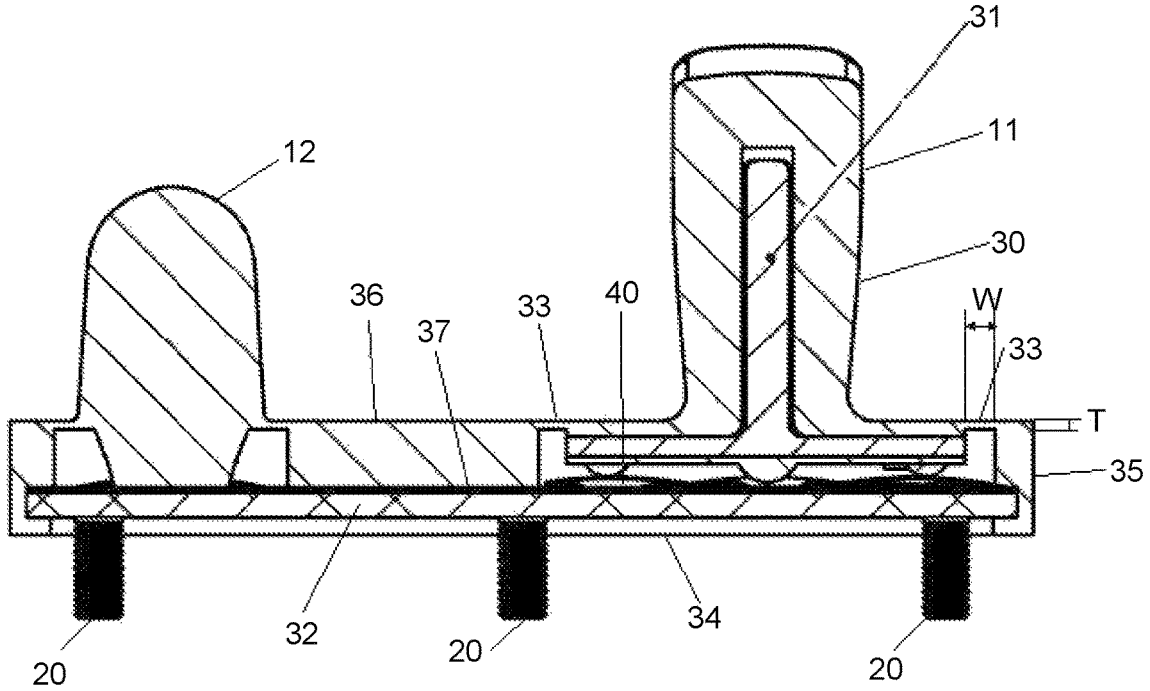
FIG. 7 is a rear sectioned view of the exemplary embodiment of a switch panel with a joystick and a rocker switch.

In FIG. 6 is a bottom view of the switch panel 10 identifying the location of section A-A in FIG. 7. The bottom of the switch panel 10 can optionally include a potting compound 34 to seal the bottom of the switch panel 10 and to provide additional strength. In some embodiments, the potting compound is a nonconductive material applied in liquid form and then hardened into a solid. For many application, it is preferable for the potting compound to be a solid at room temperature. The potting compound 34 can enhance the waterproof or water-resistant qualities of the switch panel 10 by providing a continuous seal in conjunction with the switch panel overlay material 35.

In FIG. 7 is a rear sectioned view of the switch panel 10 taken along section A-A identified in FIG. 6. The switch panel overlay material 35 preferably comprises a silicone rubber. In some embodiments, the switch panel overlay material 35 may comprise a natural or synthetic rubber mixture tuned for the particular joystick characteristics. In some embodiments, the upper surface of the switch panel overlay material 35, flex-wall 33 and joystick overlay 30 smoothly transition between the surfaces to provide a seamless appearance from above. An example of smooth transitions between the surfaces is best viewed in the top view of FIG. 4, the side view of FIG. 5 and the rear sectioned view of FIG. 7.

The joystick overlay 30 can be fixed to the upper portion of the internal actuator arm 31 to provide a user with a means for manipulating the internal actuator arm 31. The switch panel overlay material 35 can be fixed to the base 32 in a base connection area 36 to provide a stable location for the flex-wall 33. The base connection area 36 can be any area between the flex-wall 33 and the base 32 that locates the flex-wall 33 relative to the base 32. In some embodiments, the base connection area 36 comprises the switch panel overlay material 35 extending between the flex-wall 33 and the base 32. The switch panel overlay material 35 can optionally be molded over the edges of the base 32 and around to the bottom of the base 32 to provide a water-resistant seal. In some embodiments, the flex-wall 33 is fixed laterally to the base connection area 36, which locates the flex-wall 33 relative to the base 32. In some embodiments, the joystick overlay 30 is fixed laterally to the flex-wall 33, keeping the internal actuator arm 31 positioned relative to the base 32.

In some embodiments, the switch panel overlay material 35, comprising the joystick overlay 30, flex-wall 33 and base connection area 36, is molded from a single and continuous material. In some embodiments, the switch panel overlay material 35 comprises a silicone rubber with a hardness of about 60 Shore A. In some embodiments, the switch panel overlay material 35 comprises a silicone rubber with a hardness between and including 55 Shore A to 65 Shore A. In some embodiments, the switch panel overlay material 35 comprises a silicone rubber with a hardness between and including 57 Shore A to 63 Shore A. In some embodiments, the switch panel overlay material 35 comprises a silicone rubber with a hardness between and including 59 Shore A to 61 Shore A.

It is preferable for the flex-wall 33 to comprise a silicone rubber with a hardness between and including 55 Shore A to 65 Shore A. It is more preferable for the flex-wall 33 to comprise a silicone rubber with a hardness between and including 57 Shore A to 63 Shore A. It is most preferable for the flex-wall 33 to comprise a silicone rubber with a hardness between and including 59 Shore A to 61 Shore A. In some embodiments, the flex-wall 33 comprises a silicone rubber with a hardness of about 60 Shore A.

It is preferable for the flex-wall 33 to have a thickness, denoted by "T" in FIG. 7, between and including 0.015 inches to 0.020 inches. It is more preferable for the flex-wall 33 to have a thickness T between and including 0.018 inches to 0.020 inches. It is preferable for the flex-wall 33 to have a lateral width, denoted by "W" in FIG. 7, between and including 0.030 inches to 0.060 inches. It is more preferable for the flex-wall 33 to have a lateral width W between and including 0.040 inches to 0.060 inches. In some embodiments, the flex-wall 33 comprises a silicone rubber with a hardness between and including 59 Shore A to 61 Shore A, has a thickness T between and including 0.018 inches to 0.020 inches and a lateral width W between and including 0.040 inches to 0.060 inches. In some embodiments, it is preferable for the flex-wall width W to be between and including 1.5 to 4 times the flex-wall thickness T. In some embodiments, it is preferable for the flex-wall width W to be between and including 2 to 3.3 times the flex-wall thickness T.

In some embodiments, the flex-wall 33 thickness T is substantially the same across the flex-wall 33. In some embodiments, the flex-wall 33 lateral width W is substantially the same across the flex-wall 33. In some embodiments, the flex-wall 33 is substantially circular when viewed from above. In some embodiments, the flex-wall 33 thickness is configured in a gradient. In some embodiments, the flex-wall 33 width W is configured in a gradient.

In some embodiments, the switch panel overlay material 35 comprises multiple materials or sections with different material properties. For instance, in some embodiments, the joystick overlay 30, the flex-wall 33 and/or the base connection area 36 could have a different material composition and/or different material properties. In some embodiments, it is beneficial for the joystick overlay 30 to have a higher hardness than the flex-wall 33. In some embodiments, it is beneficial for the base connection area 36 to have a higher hardness than the flex-wall 33.

In some embodiments, the joystick overlay 30 can have a hardness between and including 25 Shore A to 100 Shore A and the flex-wall 33 can have a hardness between and including 25 Shore A to 90 Shore A. In some embodiments, the joystick overlay 30 has a hardness between and including 40 Shore A to 95 Shore A and the flex-wall 33 has a hardness between and including 30 Shore A to 80 Shore A. In some embodiments, the joystick overlay 30 has a hardness between and including 50 Shore A to 90 Shore A and the flex-wall 33 has a hardness between and including 35 Shore A to 80 Shore A. In some embodiments, the joystick overlay 30 has a hardness between and including 60 Shore A to 70 Shore A and the flex-wall 33 has a hardness between and including 55 Shore A to 65 Shore A.

In some embodiments, the joystick overlay 30 can have a hardness between and including 1.0 to 2.0 times the hardness of the flex-wall 33. In some embodiments, the joystick overlay material 30 can have a hardness between and including 1.0 to 1.8 times the hardness of the flex-wall 33. In some embodiments, the joystick overlay 30 can have a hardness between and including 1.1 to 1.5 times the hardness of the flex-wall 33. In some embodiments, the joystick overlay 30 can have a hardness between and including 1.0 to 1.2 times the hardness of the flex-wall 33.

In some embodiments, the thickness and/or the lateral width of the flex-wall 33 can be varied to accommodate differences in the hardness of the flex-wall 33 material. The thickness of the flex-wall 33 refers to the height of the flex-wall from its upper surface to its lower surface. For instance, if the flex-wall 33 material hardness is increased, the thickness of the flex-wall 33 could be reduced. In some embodiments, the lateral width of the flex-wall 33 can be varied to accommodate differences in the hardness of the flex-wall 33 material. The width of the flex-wall 33 refers to the lateral width between the joystick overlay 30 and the base connection area 36.

In some embodiments, the flex-wall 33 is configured to extend laterally between the joystick overlay 30 to the base connection area 36. The flex-wall 33 is preferably configured so that no portion of the flex-wall 33 is under tension when the internal actuator arm 31 is in an upright or neutral/equilibrium position. The flex-wall 33 is also preferably configured without excess material when the internal actuator arm 31 is in an upright or neutral/equilibrium position so that the flex-wall is substantially flat or without slack in this position. When the internal actuator arm 31 of the joystick 11 is manipulated in a direction (hereinafter the "direction of movement"), the flex-wall 33 on the side of the joystick 11 opposite to the direction of movement is placed in tension, resisting the joystick's manipulation in the direction of movement. Since the flex-wall 33 is generally thinner than the adjacent joystick overlay 30 and the base connection area 36, the flex-wall 33 is the first section to deform and become elongated under the tension. Since the flex-wall 33 extends laterally and resists the joystick's movement, the internal actuator arm 31 can be located relative to the base 32 by the joystick overlay 30, flex-wall 33 and the base connection area 36. While locating means may be provided between the internal actuator arm 31 and the base 32, they are not required in the present invention, reducing productions costs and complexity.

The flex-wall 33 in the exemplary embodiment extends laterally between the joystick overlay 30 and the base connection area 36, however, it is appreciated that other configurations could achieve the same results. In some embodiments, the flex-wall could be inclined towards or away from the joystick overlay 30. In some embodiments, the flex-wall 33 could have excess material and the self-righting and locating functions of the flex-wall could be replaced by another mechanism.

Figure 8:
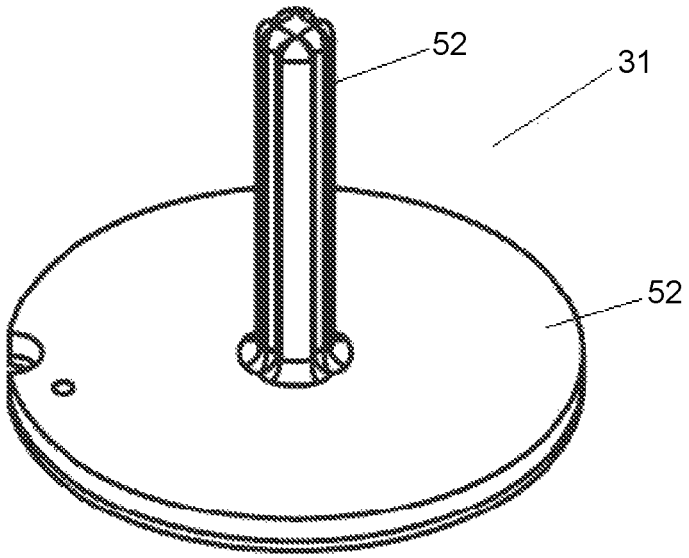
FIG. 8 is an isometric view of an internal actuator arm used in the exemplary embodiment of a joystick.

In FIG. 8 is an isometric view of the internal actuator arm 31. The internal actuator arm 31 is generally comprised of a disk 51 with a vertical elongate member 52 fixed to the upper surface of the disk 51. The vertical elongate member 52 can be fixed to the disk 51 so that the axial direction of the vertical elongate member 52 passes near the axial center of the disk 51. In some embodiments, the elongate member 52 can be fixed in a direction about normal to the upper surface of the disk 51. In some embodiments, the elongate member 52 can be fixed in a direction between 0 degrees and 90 degrees from a direction normal to the upper surface of the disk 51. In some embodiments, the elongate member 52 can have longitudinal grooves to assist in the fixation of the joystick overlay material 30.

Figure 9:
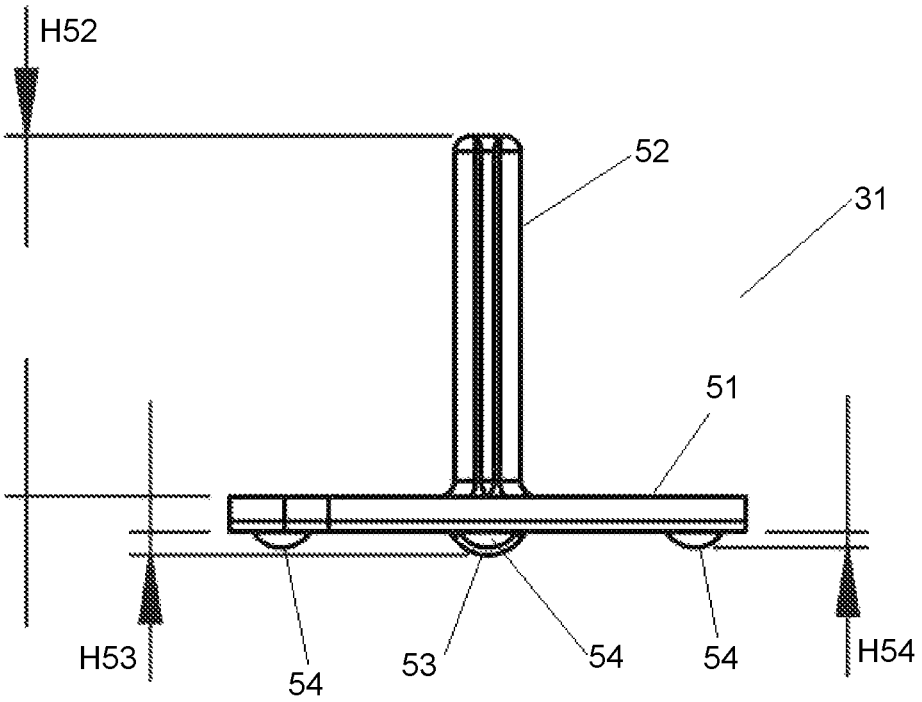
FIG. 9 is a side view of the internal actuator arm.

In FIG. 9 is a side view of the internal actuator arm 31, showing the size of the center pivot point 53 and the switch activation protrusions 54. The center pivot point 53 is preferably located below the axial center of the disk 51 and extends downward for a distance of H53, where H53 represents the height of the center pivot point 53 between the bottom of the disk 51 and the lowermost point of the center pivot point 53. The switch activation protrusions 54 are preferably equally spaced about the axial center of the disk 51 and extend downward for a distance of H54, where H54 represents the height of the switch activation protrusions 54 between the bottom of the disk 51 and the lowermost point of the switch activation protrusions 54. It is preferable for H53 to be greater than H54 to allow the joystick core 31 to pivot about the pivot point 53. In some embodiments, H53 is between and including 1.0 to 4.0 times H54.

The height of the elongate member 52, represented by H52, is measured from the top surface of the disk 51 to the top of the elongate member 52. The height H52 is preferably indexed to the height H53 of the pivot point 53 and the height H54 of the switch activation protrusions 54. The force needed to depress the momentary switches 40 can also factor into an appropriate height H52.

Figure 10:
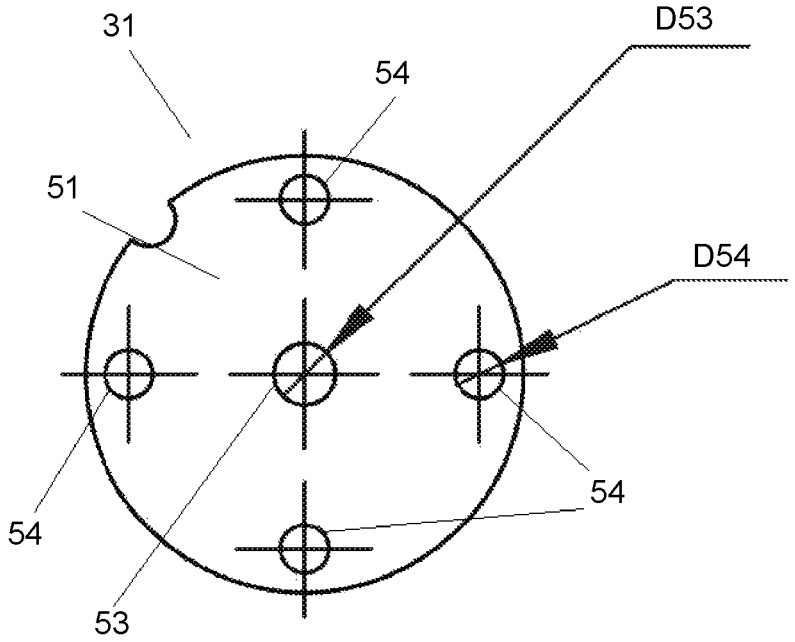
FIG. 10 is a bottom view of the internal actuator arm.

In FIG. 10 is a bottom view of the internal actuator arm 31. In this exemplary embodiment, the pivot point 53 is located below the axial center of the disk 51 and the switch activation protrusions 54 are equally spaced about the axial center of the disk 51. The pivot point 53 and switch activation protrusions 54 can be moved or adjusted, as needed, to adapt the joystick assembly for particular applications. The pivot point 53 can be dome shaped in profile to provide a gradual movement as the internal actuator arm 31 is manipulated. In some embodiments, a pivot point 53 that is pointed in profile (conical) or other shapes may be preferable. The switch activation protrusions 54 can be dome shaped in profile. In some embodiments, the switch activation protrusions can be squared off in profile or pointed in profile for particular applications.

In embodiments where the pivot point 53 and switch activation protrusions 54 are dome shaped in profile, it is preferable for the pivot point 53 to have a larger diameter than the switch activation protrusions 54 when viewed from below. The diameter of the pivot point 53 when viewed from below is represented by D53. The diameter of the switch activation protrusions 54 when viewed from below is represented by D54. In some embodiments, D53 can be between and including 1.0 to 5.0 times D54.

What has been described is an exemplary embodiment of an elastomeric joystick. While this disclosure shows the invention in specific exemplary embodiments, persons of ordinary skill in the art will appreciate that all or part of the invention is capable of being used in other configurations or other applications. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. An electrical switch assembly comprising:

a base member a first momentary switch fixed to the base member;

an actuator arm configured to activate the first momentary switch;

an elastomeric layer;

wherein, the elastomeric layer comprises an actuator arm overlay fixed to the actuator arm, a flex-wall fixed to the actuator arm overlay and a base member connection area fixed to the flex-wall;

wherein the base member connection area is fixed to the base member;

wherein the actuator arm is located laterally relative to the base member substantially via the elastomeric layer; and wherein the flex-wall comprises a thickness between and including 0.015 inches to 0.020 inches.

2. An electrical switch assembly comprising:

a base member a first momentary switch fixed to the base member;

an actuator arm configured to activate the first momentary switch;

an elastomeric layer;

wherein, the elastomeric layer comprises an actuator arm overlay fixed to the actuator arm, a flex-wall fixed to the actuator arm overlay and a base member connection area fixed to the flex-wall;

wherein the base member connection area is fixed to the base member;

wherein the actuator arm is located laterally relative to the base member substantially via the elastomeric layer; and wherein the flex-wall comprises a lateral width between and including 0.030 inches to 0.060 inches.

3. An electrical switch assembly comprising:

a base member a first momentary switch fixed to the base member;

an actuator arm configured to activate the first momentary switch;

an elastomeric layer;

wherein, the elastomeric layer comprises an actuator arm overlay fixed to the actuator arm, a flex-wall fixed to the actuator arm overlay and a base member connection area fixed to the flex-wall;

wherein the base member connection area is fixed to the base member;

wherein the actuator arm is located laterally relative to the base member substantially via the elastomeric layer; and wherein the flex-wall comprises a silicone rubber with a hardness between and including 59 Shore A to 61 Shore A, a thickness between and including 0.018 inches to 0.020 inches and a lateral width between and including 0.040 inches to 0.060 inches.

4. The electrical switch assembly of claim 3 further comprising:

a second momentary switch, a third momentary switch and a fourth momentary switch;

wherein the momentary switches are fixed to the base member and arranged in a substantially circular pattern, spaced substantially an equal distance apart; and wherein the actuator arm further comprises a central nub configured to provide a pivot point relative to the base member and four actuator nubs spaced radially from the central nub and each configured to actuate a momentary switch.

5. The electrical switch assembly of claim 4, wherein the momentary switches are selected from a group of switches consisting of dome switches and micro-switches.

6. An electrical joystick assembly comprising:

a base member;

a plurality of switches fixed towards an upper surface of the base member and spaced apart radially from a fulcrum point;

an actuator arm configured to activate a plurality of momentary switches when manipulated about the fulcrum point;

an elastomeric layer fixed to the actuator arm and the base member;

wherein the elastomeric layer further comprises a flex-wall extending between the actuator arm and the base member, configured to laterally locate the actuator arm relative to the base member;

wherein the actuator arm further comprises a disk with an elongate member fixed to the disk and extending upward and wherein the flex-wall is configured to be substantially parallel to the base member and unstressed when the actuator arm is in a neutral or equilibrium position; and wherein the actuator arm further comprises a central nub extending downward from the axial center of the disk and configured to provide the fulcrum point; and wherein the actuator arm further comprises downward facing nubs configured to actuate the switches.

7. The electrical joystick assembly of claim 6, wherein the flex-wall comprises a silicone rubber with a hardness between and including 59 Shore A to 61 Shore A, a thickness between and including 0.018 inches to 0.020 inches and a lateral width between and including 0.040 inches to 0.060 inches.

8. The electrical joystick assembly of claim 7, wherein the switches are selected from a group of switches consisting of dome switches, micro-switches and potentiometers.

9. An electrical joystick assembly comprising:

a base member;

a plurality of switches fixed towards an upper surface of the base member and spaced apart radially from a fulcrum point;

an actuator arm configured to activate a plurality of momentary switches when manipulated about the fulcrum point;

an elastomeric layer fixed to the actuator arm and the base member;

wherein the elastomeric layer further comprises a flex-wall extending between the actuator arm and the base member, configured to laterally locate the actuator arm relative to the base member; and wherein the flex-wall has a width that is between and including 1.5 to 4 times a flex-wall thickness.

* * * * *